US005136907A

United States Patent [19]

Bakermans et al.

[11] Patent Number: 5,136,907

[45] Date of Patent: Aug. 11, 1992

[54] PREVENTION OF SLUG PULLING IN STAMPING PRESSES

[75] Inventors: Johannes C. W. Bakermans; Jack F. Dubbs, both of Harrisburg; Lawrence R. Holbrook, Jonestown, all of Pa.

[73] Assignee: AMP Incorporated, Harrisburg, Pa.

[21] Appl. No.: 704,587

[22] Filed: May 22, 1991

[51] Int. Cl.[5] ..... B26F 1/14

[52] U.S. Cl. ..... 83/93; 83/149; 83/164; 83/685; 83/690

[58] Field of Search ..... 83/149, 690, 146, 97, 83/164, 685, 145, 93

[56] References Cited

U.S. PATENT DOCUMENTS

| | | | |
|---|---|---|---|
| 2,431,567 | 11/1947 | Kopczynski et al. | 83/146 |
| 4,489,871 | 12/1984 | Bakermans et al. | 226/52 |
| 4,516,450 | 5/1985 | Shuttleworth | 83/690 X |
| 4,543,865 | 10/1985 | Kramski | 83/690 X |
| 4,819,476 | 4/1989 | Bakermans et al. | 72/456 |
| 4,974,479 | 12/1990 | Bakermans et al. | 83/145 |
| 4,995,289 | 2/1991 | Bakermans | 83/690 |

OTHER PUBLICATIONS

Oberg Manufacturing Co., Inc. Bulletin 1074.

*Primary Examiner*—Douglas D. Watts
*Assistant Examiner*—Clark F. Dexter
*Attorney, Agent, or Firm*—William B. Noll

[57] ABSTRACT

Stamping die for use with a punch to produce holes in strip material with the resulting production of a slug has a camming rib in the die opening. The rib prevents slug pulling when the punch returns from its extended position to its retracted position. The camming rib causes the slug to become wedged in the die opening and is effective to move the slug laterally in its own plane across the leading edge of the punch thereby overcoming any surface tension or other forces which might cause the slug to adhere to the face of the punch. The camming rib can be straight and extend parallel to the axis of the die opening if the die opening is not tapered. If the die opening has a slight taper, the camming rib is inclined thereby to cause movement of the slug across the face of the punch as the punch moves into the die opening.

7 Claims, 9 Drawing Sheets

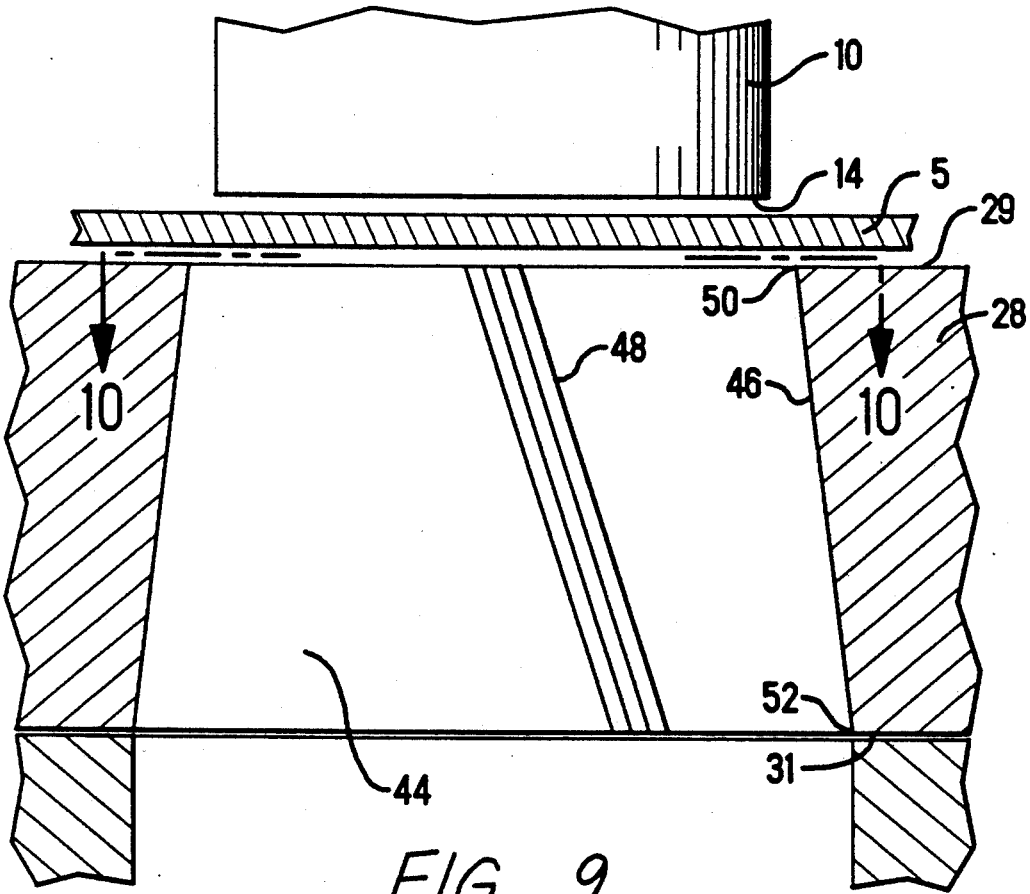
FIG. 9
FIG. 10
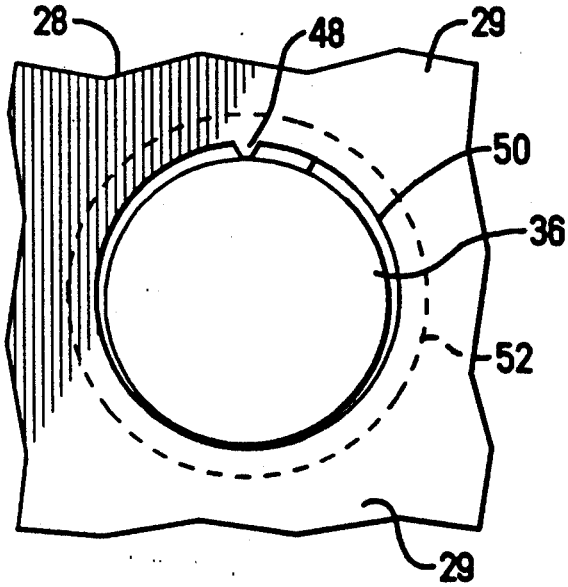

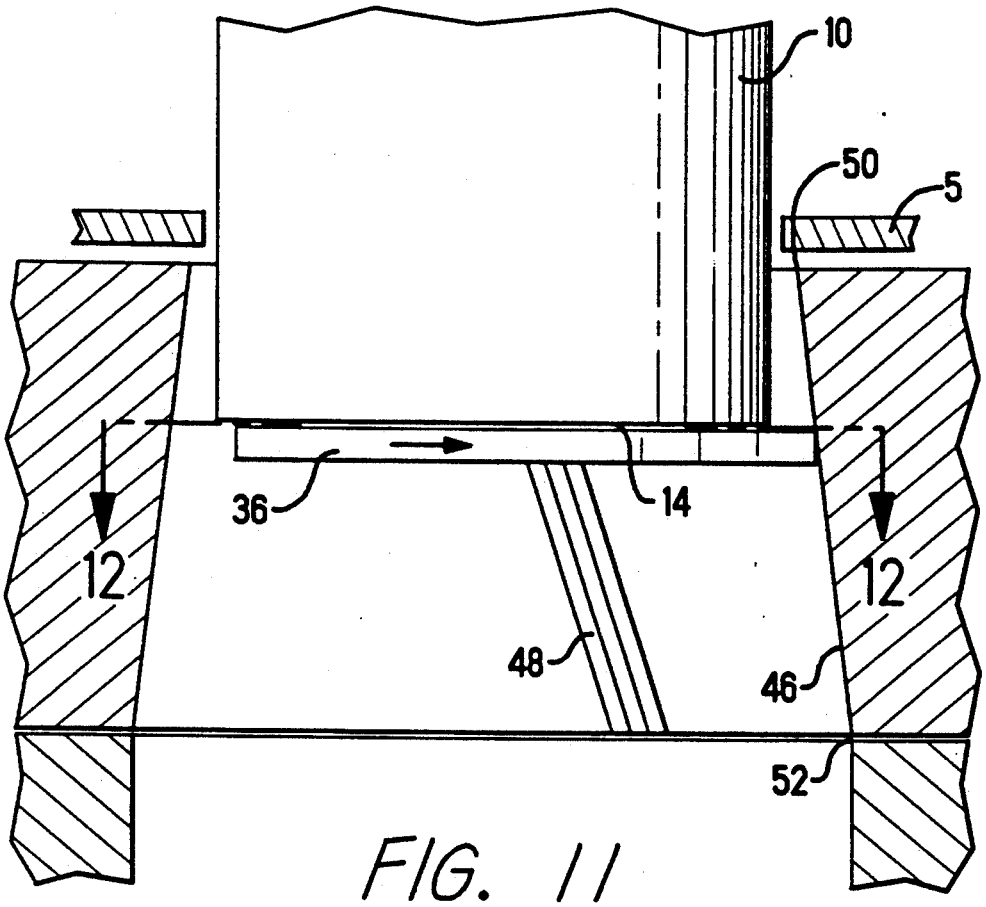
FIG. 11
FIG. 12
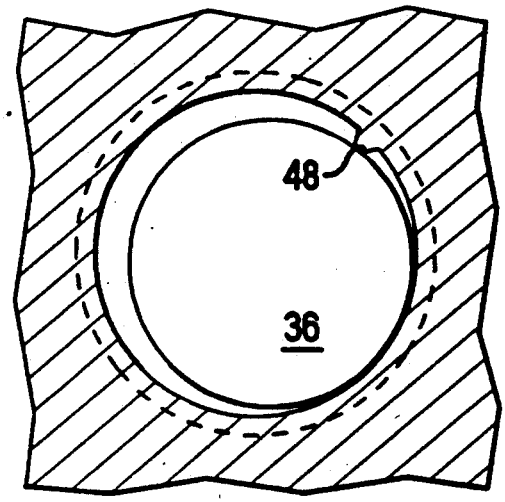

FIG. 17

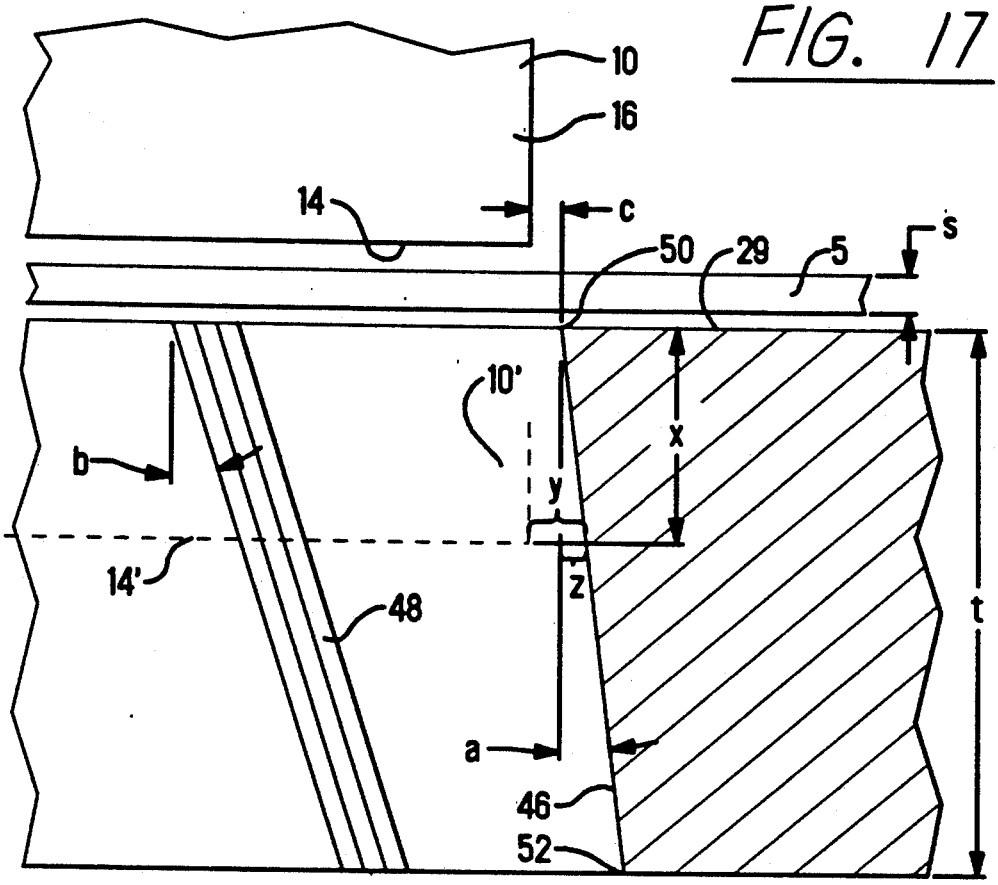

a = TAPER ANGLE OF DIE OPENING = 0.1 DEGREE
s = MATERIAL THICKNESS = 0.012 INCH (0.305MM)
c = PUNCH CLEARANCE, 8% s = 0.001 INCH (0.025MM)
y = MINIMUM MOVEMENT OF SLUG REQUIRED
z = OFFSET OF SURFACE DUE TO TAPER OF DIE OPENING
x = MOVEMENT OF PUNCH INTO DIE PLATE = 0.06 INCH (1.52MM)

$$\text{TAN } a = \frac{z}{x} \qquad z = x\text{TAN } a = 0.06 \times 0.0017 \cong 0.0001$$

$$y = c + z \cong 0.0011$$

MINIMUM ANGLE FOR b:

$$\text{TAN } b = \frac{0.0011}{0.06} = 0.018$$

$$b = \text{TAN}^{-1}\ 0.018 \cong 1.05 \text{ DEGREE}$$

FIG. 18

PREVENTION OF SLUG PULLING IN STAMPING PRESSES

FIELD OF THE INVENTION

This invention relates to stamping presses and particularly to punch and die assemblies having improvements which prevent slug pulling when a slug is stamped from strip material by the punch and pushed into the die opening.

RELATED ISSUED U.S. PATENTS

The following U.S. patents are incorporated into this description by reference:
4,819,476
4,974,479
4,995,289
4,489,871

BACKGROUND OF THE INVENTION

In a conventional stamping operation, a hole is produced in strip material by a punch which shears a slug from the material and pushes the slug into the opening in the die. The slug should remain in the die opening when the punch returns to its retracted position so that strip material can be fed and the punching operation repeated. Under some circumstances, the slug will have a tendency to adhere to the face of the punch when the punch returns to its retracted position from its extended position and will be carried with the punch. As a result, the slug remains on the face of the punch when the subsequent stamping cycle is carried out. This phenomenon, commonly referred to as "slug pulling" can be extremely troublesome and can cause breakage of the punch or other damage to the punch and die assemblies. In any event, the machine must be stopped if slug pulling occurs and the slug removed from the face of the punch before the machine can be restarted.

There are several systems which can be incorporated into the die assembly to prevent slug pulling. A vacuum can be applied behind the slug in the die opening so that the slug will be pulled from the face of the punch by the vacuum. Alternatively, compressed air jets can be provided in the die assembly which inject compressed air into the opening and cause the slug to separate from the punch. These systems are successful but are not, in general, desirable for the reason that they are wasteful of energy and have a polluting effect on the atmosphere of the room in which they are used. These systems require a continuously operating compressor or vacuum pump and are not energy efficient for that reason. Vacuum and compressed air systems have a polluting effect as a result of the fact that the air streams carry droplets of lubricant which is used in the operation of the compressors. U.S. Pat. No. 4,489,871 and the other U.S. patents cited above show a type of stamping machine having relatively small die and punch assemblies which move towards and away from each other during each operating cycle. It is not desirable to provide a vacuum system or compressed air system in machines of this type for the additional reasons that the die assemblies are relatively small and the die assembly moves during operation of the machine.

It is also possible to minimize slug pulling by designing the punch and die such that the punch clearance is extremely small, for example, 5 percent of the stock thickness or less. A punch and die assembly having a very small punch clearance results, however, in shortened punch life and requires more maintenance than is required if a generous clearance is provided, for example, 8 percent of the stock thickness. It is also possible to minimize slug pulling by beveling or otherwise providing contours on, the face of the punch but this system requires extra machining and results in higher manufacturing costs for the punches. Furthermore, it is not always successful.

The present invention is directed to the achievement of an improved die assembly having a static means therein which minimizes or entirely prevents slug pulling and which ensures that the slug produced during a stamping operation will be retained in the die opening when the punch returns to its retracted position.

THE INVENTION

One embodiment of the invention comprises a punch and die assembly for punching a hole in stock material with the resulting production of a slug, the assembly comprising a die plate having a facial surface which is opposed to the punch, a die opening which extends from the facial surface through the die plate, and the punch having a leading end portion and a leading end surface. The punch has a cross-section which conforms to the cross-section of a die opening and is reciprocable towards and away from the facial surface between a retracted position and an extended position. The leading end surface of the punch is spaced from the facial surface of the die when the punch is in its retracted position and the leading end portion of the punch extends into the die opening when the punch is in its extended position. The punch and die assembly is characterized in that the die opening has an internal wall which extends inwardly from the facial surface and a camming rib is provided on the internal wall and extends inwardly from the facial surface. The camming rib is engagable with an edge portion of the slug produced in a punching operation as the slug is pushed into the die opening and the camming rib is effective to move the slug laterally in its own plane across the leading end surface of the punch so that the slug is moved against, and becomes wedged against, a wall portion of the die opening which is remote from the camming rib whereby when the punch returns to its retracted position, the slug is separated from the leading end surface of the punch and remains or is retained in the die opening.

In the preferred embodiment, the cross-section of the punch has dimensions which are less than the dimensions of the die opening so that the leading end portion of the punch has a predetermined punch clearance in the die opening. The camming rib has a maximum height or altitude above the internal surface of the die opening which is substantially equal to the punch clearance. The camming rib preferably extends into the die opening a distance which is greater than the amount by which the leading end portion of the punch extends into the die opening when in its extended position and the camming rib extends obliquely on the internal surface of the die opening with respect to the axis of the die opening.

THE DRAWING FIGURES

FIG. 9 is a view showing an alternative embodiment having a divergently tapered die opening.

FIG. 10 is a view looking in the direction of the arrows 10—10 of FIG. 9 but showing a slug positioned in the die opening at the facial surface of the die plate.

FIG. 11 is a view similar to FIG. 9 but showing the positions of the parts when the punch is in its extended position.

FIG. 12 is a view looking in the direction of the arrows 12—12 of FIG. 11.

FIG. 17 is a view on an enlarged scale which shows some of the important dimensions and dimensional relationships in a punch and die assembly in accordance with the invention.

FIG. 18 presents an explanation of the relationships shown in FIG. 17.

THE DISCLOSED EMBODIMENT

Figure 1:
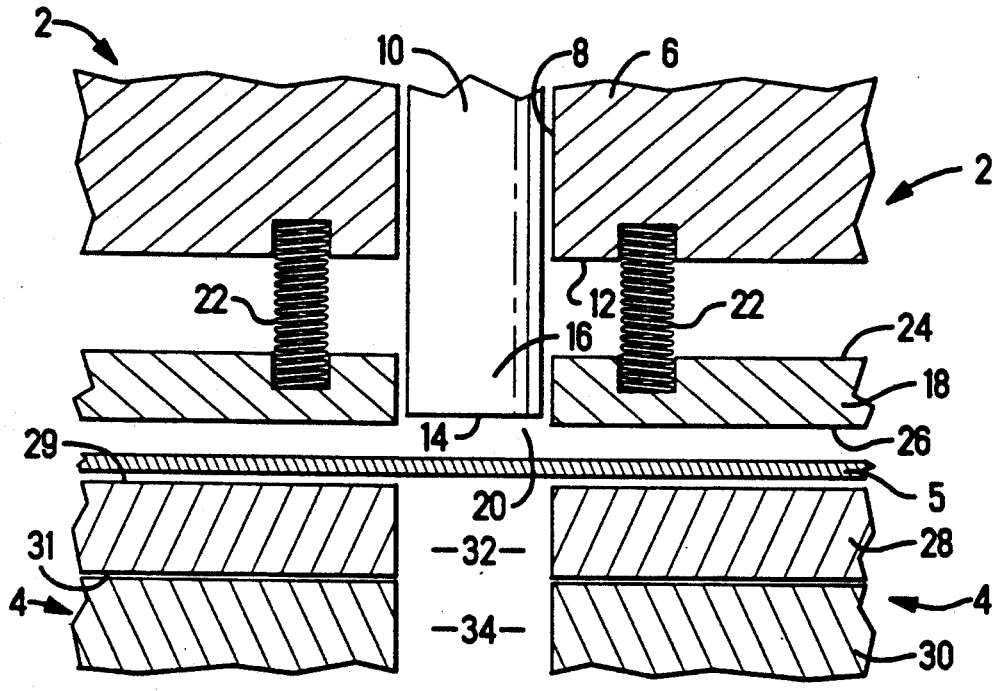
FIG. 1 PRIOR ART
FIG. 1 is a diagrammatic view showing the essential parts of a punch assembly and a die assembly in accordance with conventional prior art practice, this view showing the positions of the parts prior to the beginning of an operating cycle.
Figure 2:
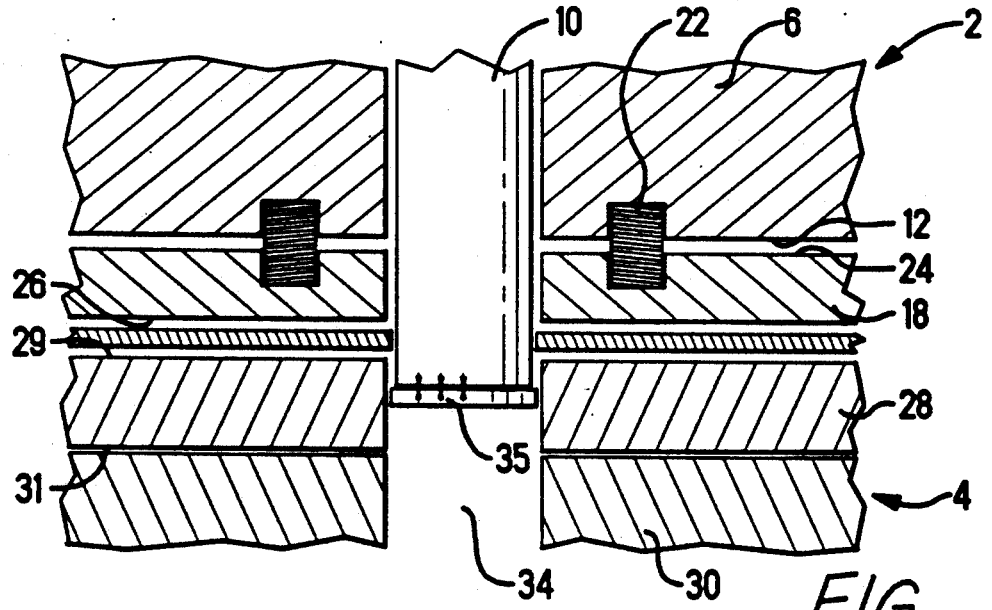
FIG. 2 PRIOR ART
FIG. 2 is a view similar to FIG. 1 showing the positions of the parts when the punch assembly is in its extended position and a slug has been sheared from the stock material and pushed into the die opening.

FIG. 1 shows a conventional punch assembly and die assembly in accordance with prior art practice for punching holes in strip material 5 with the resulting production of a slug 35, FIG. 2. In these figures, as in all other drawing figures, the clearances and dimensions are greatly exaggerated for purposes of illustration.

The punch assembly 2 comprises a punch block 6 having a facial surface 12 and a recess 8 therein in which the punch 10 is contained. The punch is secured to the punch block 6 and movable therewith as described in U.S. Pat. No. 4,995,289. The punch has a leading end portion 16 and a leading end surface 14 which moves against the stock material. A stripper plate 18 is provided which is spaced from the facial surface 12 when the parts are in the position of FIG. 1 and which is coupled to the punch block 6 by a lost motion coupling (not shown). The lost motion coupling permits movement of the punch block 6 and stripper plate 18 relatively towards each other to the position of FIG. 2 so that the rear surface 24 of the stripper plate is substantially against the surface 12 of the punch block. The stripper plate is maintained in its extended position by springs 22 and has a central opening 20 which receives the end portion 16 of the punch.

The die assembly 4 comprises a die plate 28 having a facial surface 29, which is opposed to the facial surface 26 of the stripper plate and a rear surface 31. The die plate is secured to the surface of a die backup plate or backup block 30. The die plate has an opening 32 which conforms to the cross-section of the leading end portion 16 of the punch 10. The opening 32 is in alignment with a somewhat larger passageway 34 which extends through the die backup plate 30.

During an operating cycle, the punch assembly and die assembly move relatively towards each other to the positions of FIG. 2 so that the leading end portion 16 of the punch moves through the stock material 5 and into the die opening 32. The slug 35 is severed from the stock material and pushed into the die plate opening. Normally, the punch assembly should return to its retracted position of FIG. 1 and the slug should remain in the opening 32 in the die plate; however, under some circumstances there will be forces indicated by the vertical arrows on the slug and the punch in FIG. 2 which cause the slug to adhere to the surface 14 of the punch. These forces may be a result of the fact that the stock material and the punch will ordinarily be coated with an extremely thin film of lubricant and the resulting surface tension forces may be sufficient to cause adherence of the slug to the face of the punch. Atmospheric pressures acting on the underside of the slug may also contribute to the vertical forces shown in FIG. 2 which cause the slug to adhere to the punch when the punch assembly returns to its retracted position shown in FIG. 3. When the condition which is shown in FIG. 3 exists, it is essential that the machine be stopped prior to the subsequent operating cycle for the reason that if the punch assembly moves to its closed position, the slug on the end of the punch will be pushed against the stock material, which was previously fed, and the punch may be damaged or broken as a result.

Figure 3:
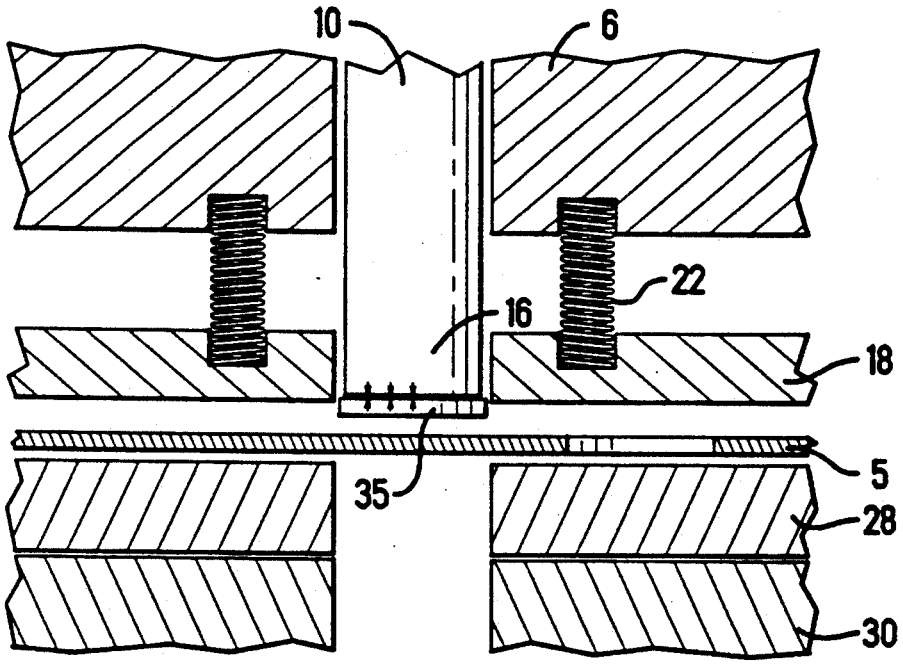
FIG. 3 PRIOR ART
FIG. 3 shows the positions of the parts after the punch assembly has returned to its retracted position and has carried with it the slug.

There are several methods of overcoming, or at least partially overcoming, the slug pulling phenomenon illustrated in FIGS. 1-3. It is known, for example, to apply a vacuum to the passageways 34 and the die opening 32 so that the slug will be pulled from the face of the punch. Alternatively, it is known to provide air jets in the die plate 28 or in the die block which remove the slug from the face of the punch when the punch returns to its retracted position. These vacuum, or compressed air systems, can be used on relatively large stamping machines where the die assembly 4 is stationary and the punch moves towards and away from the die assembly. Vacuum and compressed air systems are wasteful of energy and have a polluting effect as explained above. The above-identified U.S. patents show stamping machines in which the punch assembly and the die assembly both move and it is difficult to provide compressed air lines or vacuum lines to a moving die assembly. Also, the machines shown in the above-identified patents have relatively small die assemblies, as compared with conventional stamping presses, and it is difficult to provide vacuum or compressed air to these relatively small die assemblies.

Slug pulling can be minimized at least by reducing the punch clearance, that is, the dimensional clearance between the surface of the punched end and the wall of the die opening 32. A reduced, or extremely limited, punch clearance is not always a desirable solution for the reason that stresses are increased on the punch and maintenance costs for the die assembly and the punch assembly are increased.

Figure 4:
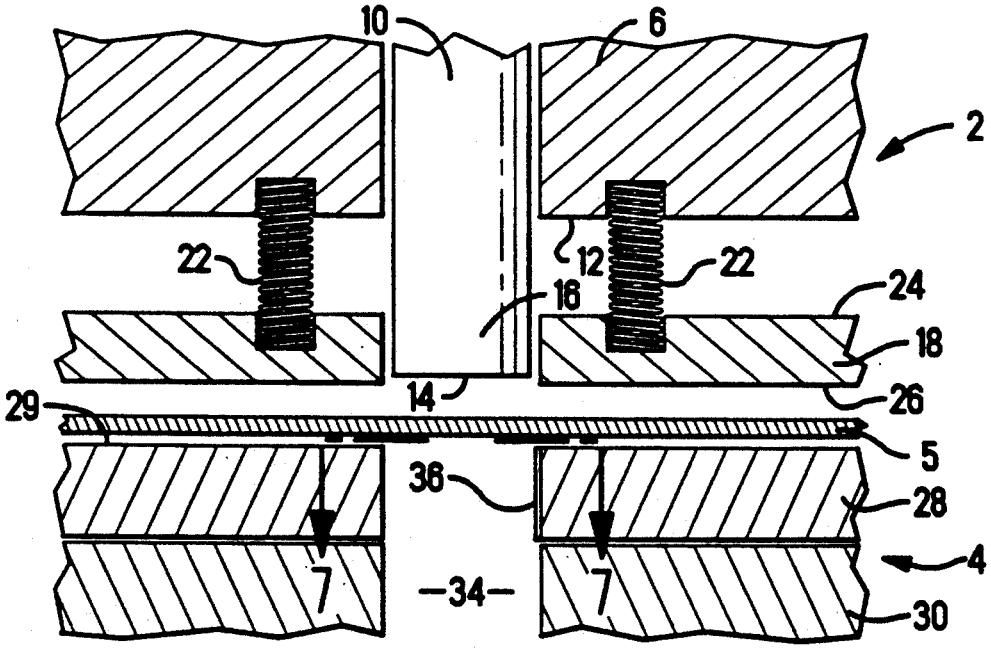
FIG. 4 is a view similar to FIG. 1 but showing a die assembly incorporating the present invention.

FIG. 4 shows a punch assembly and a die assembly in accordance with the present invention. The two assemblies are similar to the punch and die assemblies of FIG. 1 and are identified with the same reference numerals.

Figure 7:
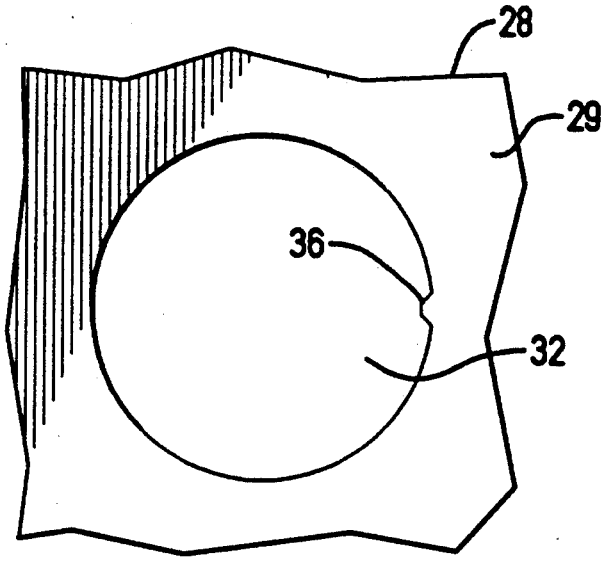
FIG. 7 is a view looking in the direction of the arrows 7—7 of FIG. 4.
Figure 8:
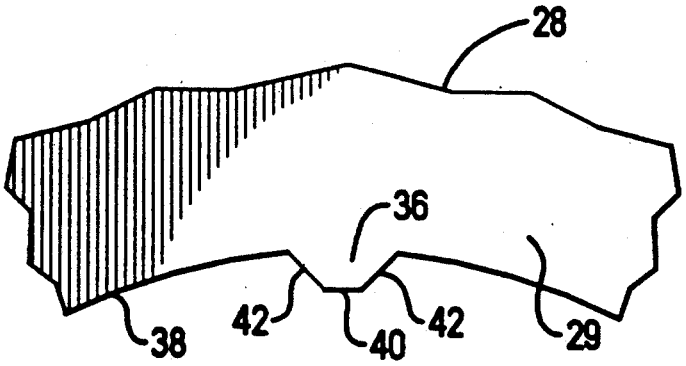
FIG. 8 is a fragmentary view on a greatly enlarged scale showing the camming rib in the die opening.

The die plate of the die assembly in FIG. 4 has a camming rib 36 which extends from the surface 29 of the die plate to the surface 31. In FIG. 4, it is assumed that the die opening 32 is circular, see FIG. 7, and the rib extends parallel to the axis of the die opening. The rib is quite small, as shown in FIG. 8, and has a crown 40 and sloping sides 42 which extend to the internal wall 38 of the die opening. The actual altitude of the crown or 36 of the rib above the adjacent surface 38 is preferably substantially equal to the punch clearance of the punch 10 in the die opening 32. It is desirable to provide the crown 40 on the rib for the reason that the crown bears against the slugs 35 as will be described below.

Figure 5:
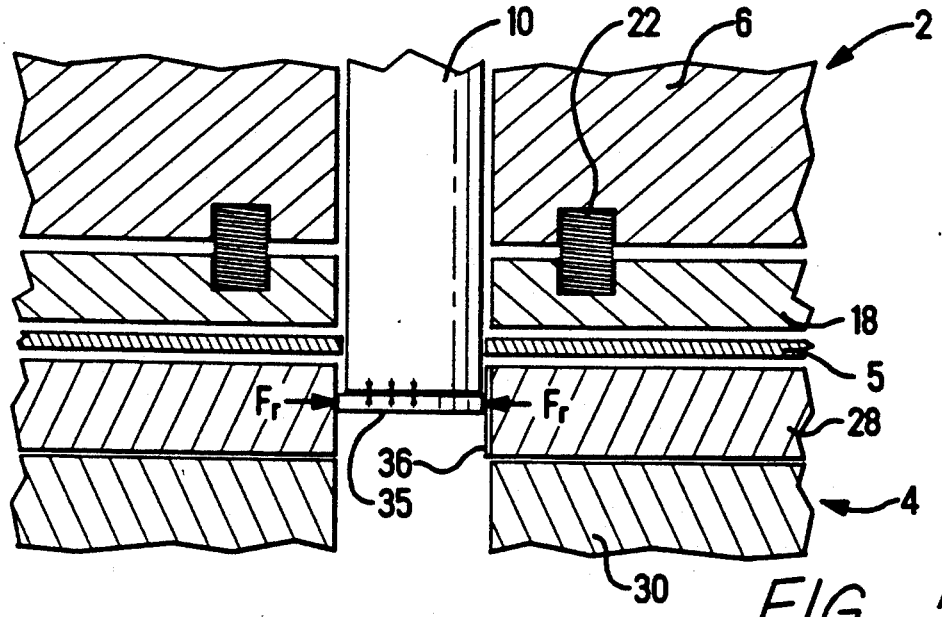
FIGS. 5 and 6 are views similar to FIGS. 2 and 3 showing the operating cycle in accordance with the invention.
Figure 6:
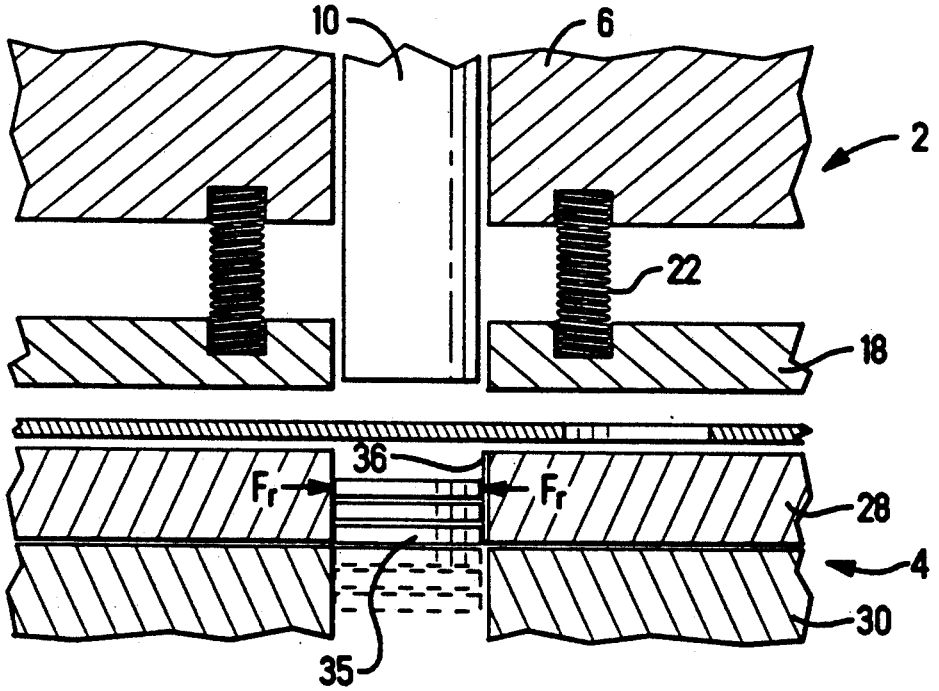

When the punch shears the slug 35 from the stock material 5 and pushes the slug into the die opening 32, the slug is caused by the rib to move laterally with respect to the axis of the die opening so that it becomes wedged between the rib 36 and portions of the internal wall of the die opening which are diametrically opposite to the rib. As a result, the slug becomes wedged, as shown in FIGS. 5 and 6, and horizontal forces Fr are imposed on the slug as indicated by the horizontal arrows in FIG. 6. These horizontal forces are sufficient to overcome the vertical forces indicated in FIG. 5 so that the slug remains in the die opening when the punch returns to its retracted position. FIG. 6 shows a stack of slugs in the die opening and in the passageway 34 which were produced during previous operating cycles.

FIG. 9 shows a die plate 28 having a die opening which is tapered so that the internal wall 46 of the die opening 44 extends divergently from the edge 50 on the surface 29 to the edge 52 on the surface 21. It is desirable to provide a very slight taper in the die opening 44 in order to prevent jamming or close packing of slugs in the die opening. The taper is achieved by increasing the transverse dimensions of the die opening by about 0.0006 inches to 0.0007 inches (0.015 mm to 0.017 mm) on every side of the opening. The increase in transverse dimensions will result in a taper angle of about 0.1 degree to about 0.3 degrees depending on the thickness of the die plate. A die plate having a thickness of 0.36 inches (9.144 mm) will have a taper angle of about 0.1 degrees and a die plate having thickness of 0.25 inches (6.35 mm) will have a taper angle of about 0.2 degrees. When the die opening 44 is tapered, it is desirable to provide a rib 48 which is substantially similar to the rib previously described but which is inclined on the surface 46 at an angle which exceeds the angle of inclination of the surface 46, in other words, an angle which exceeds the taper of the die opening. The taper need not be provided in the vicinity of rib 48.

When the punch moves downwardly from the position of FIG. 9, the resulting slug will be moved into the die at the surface 29 as shown in FIG. 10 and the rib 48 will function as described above to wedge the slug against portions of the wall 46 which are diametrically opposite to the rib. As the leading end portion of the punch moves further into the die opening as shown in FIG. 11, the slug is moved laterally across the face 14 of the punch in a rightward direction as viewed in the drawing by the rib which is inclined rightwardly. The slug moves, as shown in FIGS. 9 and 11, against the surface 46 of the opening for the reason that as it is pushed into the die opening and moves downwardly relatively to the rightwardly inclined rib, it tends to take the path of least resistance and the rib cams the slug in the rightward direction as shown. When the punch moves relatively upwardly from the position of FIG. 11, the slug is captured by reaction forces imposed upon it by the die plate and additionally, it is now beneath and beyond the edge 50 of the die opening at the upper surface 29. Also, the movement of the slug across the face of the punch breaks the surface films and reduces surface tension effects which encourage the slug to adhere to the punch. The slug is thereby discouraged from moving upwardly with the punch and the surface tension or other forces which would otherwise cause the slug to move with the punch are overcome by the forces imposed in a horizontal direction in FIG. 11.

Figure 13:
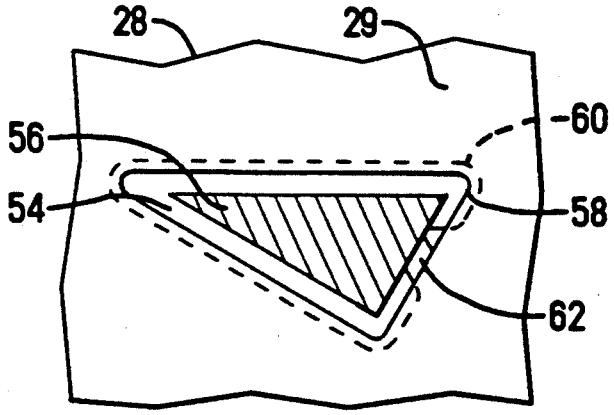
FIGS. 13 and 14 are plan views of the facial surfaces of a die plates of alternative embodiments.

FIG. 13 shows portions of a die plate 28 having a generally triangular die opening 54 therein and a correspondingly shaped punch 56. The slug is not shown in FIG. 13 and can be assumed to be beneath the punch which is positioned in the die opening. The die opening 54 is tapered, excepting in the vicinity of the rib, and the edge 58 of the die opening at the surface 29 is spaced inwardly from the edge 60 of the die opening at the rear face as indicated by the broken line. A camming rib 62 is provided on one side of the die opening and is inclined relative to the axis of the opening as described above so that as the slug is pushed into the die opening, it will be moved laterally across the face of the punch and beneath the overhang of the die opening provided by the taper.

Figure 14:
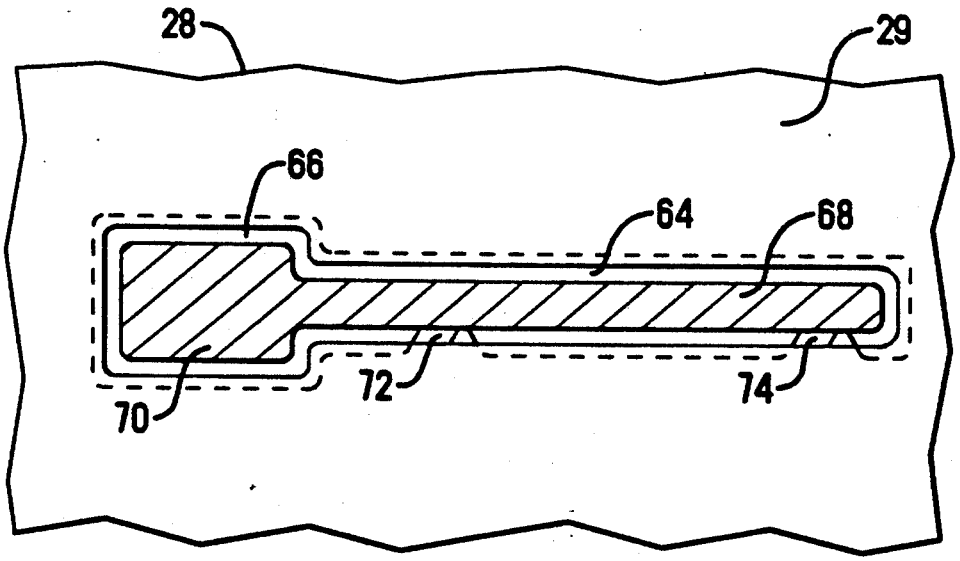

FIG. 14 shows a die plate having a die opening 64 which is relatively elongated but has an enlarged end 66. The punch 68 similarly has an elongated portion and an enlarged end portion 70. As described above, clearance is provided between the punch and the die opening and the die opening is tapered as shown by the broken lines surrounding the die opening at the surface 29. In an embodiment of this type, in which the resulting slug will be elongated, it is often desirable to provide more than one rib and the disclosed die plate has two ribs 72, 74 which are inclined leftwardly towards the enlarged end 66 of the die opening so that the slug will be pushed to the left by the ribs 72,74.

Figure 15:
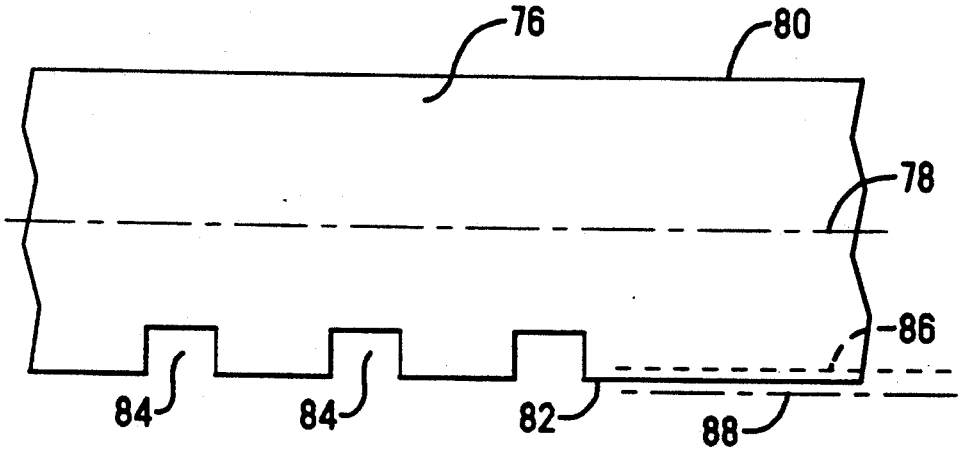
FIG. 15 is a plan view of a strip of stock material which has been notched along one of its edges.
Figure 16:
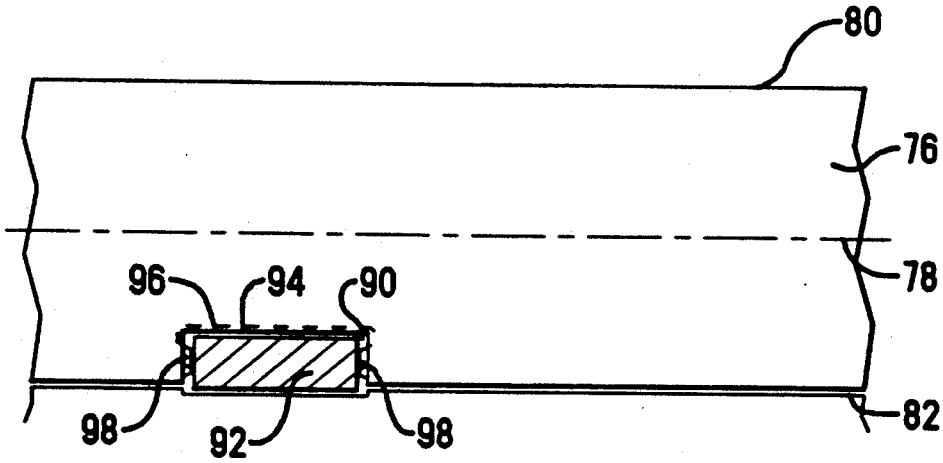
FIG. 16 is a plan view of a die for forming the notches in the strip shown in FIG. 15.

FIGS. 15 and 16 illustrate the use of the invention in forming notches 84 in one edge 82 of a strip 76. The strip 76 has a center line 78 which is equidistant from the side edges 80, 82. Strip material always has a nominal dimension plus or minus a tolerance. In FIG. 15, the edges 80, 82 are assumed to be the edges of strip having the nominal width of the strip. The edges indicated by the broken lines 86, 88 indicate the edges of strip which has the minimum width and the maximum width, respectively, within the tolerance limits.

Punches and dies for forming notches 84 in the edge 82 must be such that the notches will be formed regardless of whether the strip has a side edge located as shown at 86 or a side edge shown at 88 or at any intermediate location. The die plate 28 for forming the notches has a rectangular opening 90 and the punch 92 is rectangular. Again, suitable punch clearance is provided and the die opening is tapered so that the edge 94 on the surface 29 is spaced inwardly from the edge 96 on the rear surface of the die plate. In this embodiment, ribs 98 are provided on the opposite sides of the die opening which cause the slug to move towards the center line 78 of the strip as it is pushed into the die opening by the punch. In this embodiment, the die opening is taped only on the side which is adjacent to the center line 78. The use of the invention in edge notching operations overcomes many of the problems commonly encountered by virtue of the fact that the strip material is not of precise width and the punch and die for notching the strip must be capable of accommodating strips of varying widths within the tolerance limits.

The inclination of the camming rib when used in a tapered die opening can be determined from a consideration of some of the dimensions shown and described in FIGS. 17 and 18. In these Figures, it is assumed that the taper angle a of the die opening is 0.1 degree and the stock thickness s is 0.012 inches (0.305 mm). It is also assumed that the punch clearance c is 8 percent of the stock thickness or about 0.001 inches (0.025 mm). The distance x, 0.06 inches (1.52 mm), indicates the movement of the leading end portion 16 of the punch into the die opening. The solid line positions 10, 14 in FIG. 17 show the punch in its retracted position and the dotted line position 10', 14' shows the punch in its extended position so that the slug would be against the surface 14' of the punch. The slug must be moved laterally as it is pushed into the die opening a distance y indicated in FIG. 17 which is equal to the punch clearance c plus an additional distance z to take into account the overhand of the edge 50 of the die opening. As described in FIG. 18, the distance z can be calculated from the tangent of the angle a and the distance x and is, in the case of the example shown, equal to about 0.0001 inches (0.002 mm). The total distance y, then, the amount by which the slug must be moved laterally across the face of the punch, is 0.0011 inches (0.003 mm).

The theoretical minimum angle of inclination b for the camming rib 48 can thus be calculated as shown in FIG. 17 and will be found to be 1.05 degrees. This is, however, a theoretical minimum and it is desirable to exceed the minimum by a substantial amount. The minimum distance y equals 0.0011 inches (0.003 mm) but in order to insure such movement of the slug with a resulting wedging of the slug and disturbance of the surface films, the angle b can be selected such that the rib is capable of moving the slug a distance of 0.003 inches (0.076 mm). If the angle b is again calculated, it will be found to be substantially 3 degrees. The angle b is not critical but will, in all cases, be a relatively slight angle. FIG. 17 shows that where the stock is relatively thin, 0.012 inches (0.0305 mm), and the punch clearance is 8 percent of the stock thickness, 0.001 inch (0.025 mm), the altitude or height of the camming rib will be very, very slight, on the order of 0.001 inch or equal to the punch clearance.

Because of the fact that the rib extends diagonally in the die opening is only about 0.001 inch (0.025 mm) above the surface 46, the die opening cannot be formed by conventional machining methods as by a shaper or broaching machine. The die opening with the extremely low rib therein which is inclined with respect to the axis of the opening can readily be formed by wire EDM (electrical discharge machining) methods. There are machines currently available which are capable of forming die openings in accordance with the invention as described herein. Mitsubishi B Series wire cut systems, DWC90B or DWC90SB produced by Mitsubishi Electric Corporation and Agicut machines available from Agie USA Lt. can be used to produce tapered die openings having camming ribs as described above. Software for use with these machines is available from D. T. Technology Corp. of Camarilla, California, and from International Manufacturing Software Inc. of Newbury Park, California. Such wire EDM machines are controlled by a computer and a suitable program must be produced to control the machine to produce ribs. Such programs are entirely within the abilities of present program producers for wire EDM machines.

Under some circumstances, a die insert is provided in the die block at the facial surface as explained in U.S. Pat. No. 4,995,289. That patent specifically describes an extremely thin insert having thickness of only about 1.57 mm. Where an extremely thin insert is used, the present invention is not provided on the insert. However, where the die insert is relatively thick, say 12 mm or more, the rib in accordance with the invention can be provided on the die insert rather than in the die block.

The salient advantage of the invention is that it prevents slug pulling and insures retention of slugs in the die opening by a modification to the die plate which does not involve moving parts. An additional advantage is that it permits the use of relatively generous punch clearances, as high as 8 or more percent of the stock thickness, in a stamping die assembly. A generous punch clearance, in turn, results in lower stresses on the punch during operation and longer punch life.

We claim:

1. A punch and die assembly for punching a hole in stock material with the resulting production of a slug, the assembly comprising a die plate having a facial surface which is opposed to the punch, a die opening which extends from the facial surface through the die plate, the punch having a leading end portion and a leading end surface, the punch having a cross-section which conforms to the cross-section of the die opening, the punch being reciprocable towards and away from the facial surface between a retracted position and an extended position, the leading end surface being spaced from the facial surface when the punch is in its retracted position and extending into the die opening when the punch is in its extended position, the punch and die assembly being characterized in that:

the die opening has an axis and an internal wall, the die opening being tapered so that the internal wall extends divergently from the facial surface, a camming rib is provided on the internal wall and extends inwardly from the facial surface along the internal wall, the camming rib extending obliquely along the internal wall relative to the axis of the die opening, the camming rib being engageable with an edge portion of the slug produced in a punching operation as the slug is pushed by the punch into the die opening and is effective to move the slug laterally in its own plane across the leading end surface of the punch whereby, when the punch returns to its retracted position, the slug is separated from, and does not adhere to, the leading end surface of the punch.

2. A punch and die assembly as set forth in claim 1 characterized in that the cross-section of the punch has dimensions which are less than the dimensions of the cross-section of the die opening so that the leading end portion of the punch has a predetermined punch clearance in the die opening, and the camming rib has a maximum height above the internal surface of the die opening which is substantially equal to the punch clearance.

3. A punch and die assembly as set forth in claim 2 characterized in that the camming rib extends into the die opening a distance which is greater than the amount by which the leading end portion of the punch extends into the die opening when in its extended position, and the camming rib extends obliquely along the internal wall of the die opening with respect to the axis of the die opening.

4. A punch and die assembly as set forth in either of claims 1 or 3 characterized in that the die opening and the rib each has an angle of inclination with respect to the axis of the die opening, the angle of inclination of the rib along the internal wall being greater than the angle of inclination of the die opening.

5. A punch and die assembly as set forth in claim 4 characterized in that the angle of inclination of the rib is sufficient to move the slug across the surface of the punch by a distance which is greater than the amount by which the die opening is enlarged as a result of the taper of the die opening.

6. A punch and die assembly as set forth in either of claims 1 or 2 characterized in that the die opening is non-circular.

7. A punch and die assembly as set forth in claim 6 characterized in that the die opening is elongated and at least two camming ribs are provided.

* * * * *